US009803929B2

(12) United States Patent
Aaron et al.

(10) Patent No.: US 9,803,929 B2
(45) Date of Patent: Oct. 31, 2017

(54) INDIRECT HEAT EXCHANGER

(71) Applicant: Baltimore Aircoil Company, Inc., Jessup, MD (US)

(72) Inventors: David Andrew Aaron, Jessup, MD (US); Zan Liu, Jessup, MD (US); Philip Hollander, Jessup, MD (US)

(73) Assignee: Baltimore Aircoil Company, Inc., Jessup, MD (US)

( * ) Notice: Subject to any disclaimer, the term of this patent is extended or adjusted under 35 U.S.C. 154(b) by 658 days.

(21) Appl. No.: 14/095,874

(22) Filed: Dec. 3, 2013

(65) Prior Publication Data

US 2014/0209279 A1 Jul. 31, 2014

Related U.S. Application Data

(60) Provisional application No. 61/732,514, filed on Dec. 3, 2012.

(51) Int. Cl.

| | |
|---|---|
| ***F28D 5/02*** | (2006.01) |
| ***F28B 1/06*** | (2006.01) |
| *F25B 39/04* | (2006.01) |
| *F28B 1/02* | (2006.01) |
| *F28B 9/10* | (2006.01) |
| *F28D 7/02* | (2006.01) |

(52) U.S. Cl.

CPC ..... *F28D 5/02* (2013.01); *F28B 1/06* (2013.01); *F25B 39/04* (2013.01); *F28B 1/02* (2013.01); *F28B 9/10* (2013.01); *F28D 7/024* (2013.01)

(58) Field of Classification Search

CPC ..... F28B 9/10; F28B 1/02; F28B 1/06; F28B 39/04; F28D 7/024

USPC ..... 165/110, 125, 163, 165, 183, 112

See application file for complete search history.

(56) References Cited

U.S. PATENT DOCUMENTS

| | | | | |
|---|---|---|---|---|
| 3,800,553 A * | 4/1974 | Engalitcheff, Jr. | F28D 5/02 | 261/152 |
| 4,196,157 A * | 4/1980 | Schinner | F28D 5/02 | 165/900 |
| 5,108,469 A * | 4/1992 | Christ | B01D 53/74 | 95/214 |
| 6,766,655 B1 * | 7/2004 | Wu | F28B 1/06 | 165/110 |
| 7,140,195 B1 * | 11/2006 | Fair | F24F 5/0035 | 261/151 |
| 2009/0049846 A1 * | 2/2009 | Jensen | F24F 1/06 | 62/121 |

* cited by examiner

*Primary Examiner* — Dominick L Plakkoottam
*Assistant Examiner* — Joel Attey
(74) *Attorney, Agent, or Firm* — Edward J. Brosius

(57) ABSTRACT

A heat exchange apparatus is provided with an indirect evaporative heat exchange section. An evaporative liquid is downwardly distributed onto the indirect section to indirectly exchange sensible heat with a hot fluid stream flowing within a series of enclosed circuits which comprise the indirect evaporative heat exchange section. An ideal flow rate for such evaporative liquid is between 2.0 and 4.0 gallons per minute per square foot of top surface area of the indirect heat exchange section.

2 Claims, 5 Drawing Sheets

INDIRECT HEAT EXCHANGER

BACKGROUND OF THE INVENTION

The present invention relates generally to an improved heat exchange apparatus such as an evaporative closed circuit cooling tower, evaporative fluid cooler or evaporative condenser. More specifically, the present invention relates to an evaporative fluid cooler or evaporative condenser having indirect evaporative fluid heat exchange sections arranged in such manner that an evaporative liquid, usually water, is distributed across the indirect heat exchange section. When compared to other similarly sized indirect, evaporative heat exchange products, the indirect heat exchange section of present invention is capable of achieving greater heat transfer capability per unit size and lower operating cost due to a use of less water flow rate as evaporative liquid.

In accordance with the present invention, a generally uniform temperature liquid is distributed over the outside surface of an indirect heat exchange section, which is comprised of a series of individual, enclosed circuits tier conducting a fluid stream to be heated or cooled. When used as a closed circuit cooling tower or evaporative condenser, heat is indirectly transferred from the fluid stream to the surrounding film of evaporative liquid. Heat retained by the evaporative liquid is directly transferred to an air stream passing through the indirect evaporative heat exchange section. The evaporative liquid draining from the indirect heat exchange section, is then collected in a sump and then pumped upwardly for redistribution across the indirect evaporative heat exchange section.

Depending upon the specific application, the fluid stream can be used to either liberate or absorb heat to or from the air stream, making the value of the heat exchanged to the air stream either positive or negative.

The present invention is concerned with an indirect heat exchange apparatus and method which achieves maximization of the heat exchange efficiencies of the indirect heat exchange section.

In an indirect evaporative heat exchanger, three fluid streams are involved; an air stream, an evaporative liquid stream, and an enclosed fluid stream. The enclosed fluid stream first exchanges sensible heat with the evaporative liquid through indirect heat transfer, since it does not directly contact the evaporative liquid, and then the evaporative liquid and the air stream evaporatively exchange heat and mass when they directly contact each other.

The majority of closed circuit cooling towers evaporative fluid coolers and evaporative condensers are stand alone indirect evaporative heat exchangers.

The present invention represents a unique improvement over the prior art by offering the most efficient way to operate such heat exchangers.

SUMMARY OF THE INVENTION

In a closed circuit cooling tower or evaporative fluid cooler, an initially hot fluid, usually water, is generally directed downwardly through a series of circuits, usually in the form of serpentine tubes or coils, which comprise an indirect evaporative heat exchange section, where the hot fluid undergoes indirect sensible heat exchange with a cooler evaporative liquid, again usually water, gravitating over the outside surfaces of the circuits. As heat is transferred sensibly from the hot fluid, the evaporative liquid initially increases in temperature as it gravitates downwardly through the indirect evaporative heat exchange section. Simultaneously, cooler ambient air is drawn over the circuits in a path that is counterflow, concurrent or cross current with the gravitating evaporative liquid. Heat absorbed by the evaporative liquid is transferred to the moving air stream as it flows downwardly over the circuits.

The evaporative liquid passing through the indirect heat exchange section is collected in the sump which has the same temperature as in the water distribution system.

When applied as an evaporative condenser, the process is the same as explained for the closed circuit fluid cooling apparatus except that since the refrigerant condenses at an isothermal condition, the flow of the fluid, now a refrigerant gas, is typically piped to the top of the coil in order to facilitate downward drainage of the condensate.

In the closed circuit fluid cooling tower of the present invention, it was discovered that distributing a lesser amount of evaporative liquid than in existing systems and thought to be required for optimal performance over the indirect evaporative heat exchange section had a substantial effect upon the performance of heat exchange within that section.

A method of operating an indirect heat exchanger comprising

The steps of providing:

providing an indirect heat exchanger comprising a plurality of coils having length sections and bend sections, a fan to draw air across the plurality of coils, a water distribution system located above the plurality of coils and comprising a series of discharge sections, an inlet header connected to the series of discharge sections, a plurality of openings in each discharge section that allow water to be distributed downwardly over the plurality of coils and a sump to collect the water after passing over the plurality of coils, wherein the water distribution system also comprises an exit opening in the sump, and a pump connected to the exit opening, and a return line to supply the water from the sump to the inlet header of the water distribution system, wherein said water discharge rate is fixed at 3.0 GPM/ft^2±0.5 GPM/ft^2 when the indirect heat exchanger falls within the parameters described in equation 1 set forth below.

A method of operating an indirect heat exchanger comprising:

providing an indirect heat exchanger comprising a plurality of coils having length sections and bend sections, a fan to draw air across the plurality of coils, a water distribution system located above the plurality of coils and comprising a series of discharge sections, an inlet header connected to the series of discharge sections, a plurality of openings in each discharge section that allow water to be distributed downwardly over the plurality of coils and a sump to collect the water after passing over the plurality of coils, wherein the water distribution system also comprises an exit opening in the sump, and a pump connected to the exit opening, and a return line to supply the water from the sump to the inlet header of the water distribution system, wherein the water being discharged from the water distribution system onto the plurality of coils is between 2.0 and 4.0 gallons per minute per square foot of the surface area of the plurality of coils.

A method of operating an indirect heat exchanger comprising:

providing an indirect heat exchanger comprising a plurality of coils having length sections and bend sections, a fan to draw air across the plurality of coils, a water distribution system located above the plurality of coils and comprising a series of discharge sections, an inlet header connected to the series of discharge sections, a plurality of openings in each discharge section that allow water to be distributed downwardly over the plurality of coils and a sump to collect the water after passing over the plurality of coils, wherein the water distribution system also comprises an exit opening in the sump, and a pump operatively connected to a return line to supply the water from the sump to the inlet header of the water distribution system, wherein the pump can be operated to provide water from the sump to the inlet header at a water discharge rate, the water discharge rate being calculated according to:

$$DZP=C_f*NROWS*[(NCKTS*D_p)/C_w]\hat{}2 \quad \text{Equation 1}$$

Where: DZP=Density Zone Profile Number $C_f$=correction factor for fins described in table 1

NROWS=number of tubes fed from top to bottom

NCKTS=number of circuits in a casing width $D_p$=projected tube diameter, inches $C_w$=casing width, inches Wherein DZP is the density zone profile of the plurality of coils, and the water discharge rate is between 2.0 and 4.0 gallons per minute per square foot of top surface area of the plurality of coils when DZP is greater than 10.

A method of operating an indirect heat exchanger comprising:

providing an indirect heat exchanger comprising a plurality of coils having length sections and bend sections, with each coil having an inlet opening and an exit opening, an inlet coil header connected to the inlet opening of each coil and an outlet coil header connected to the outlet opening of each coil, the plurality of coils formed into a coil structure, a fan to draw air through the coil structure, a water distribution system located above coil structure, the water distribution system comprising a plurality of water discharge sections, an inlet distribution header connected to the plurality of water discharge sections, a plurality of openings in each water discharge section that allow water to be distributed downwardly over the coil structure, and a sump to collect the water after passing over the coil structure, wherein the water distribution system also comprises an exit opening in the sump, and a pump connected to the exit opening, and a return line to supply the water from the sump to the inlet distribution header, wherein an airside static pressure drop of the coil structure is measured as SP, wherein the pump can operate at various speeds to provide varying pumping rates, and wherein the pumping rate can be varied to adjust a total water discharge rate from the plurality of water discharge sections onto the coil structure according to a formula that if SP is greater than 1 inch of water column, the total water discharge rate onto the coil structure is between 2 and 4 gallons per minute per square foot of surface area of the coil structure.

It is therefore an object of the present invention to provide an apparatus and method for evaporative fluid cooling or evaporative condensing, whereby an indirect heat exchange section delivers improved heat transfer performance.

It is another object of the invention to provide an apparatus and method for evaporative fluid cooling or evaporative condensing, whereby an indirect heat exchange system originally designed for high spray flow rates can be retrofitted to deliver improved heat transfer performance.

It is another object of the invention to provide an apparatus and method for evaporative fluid cooling or evaporative condensing, whereby an indirect heat exchange system originally designed for high spray flow rates can be retrofitted to deliver improved heat transfer performance with pump energy cost savings.

DETAILED DESCRIPTION

Figure 1:
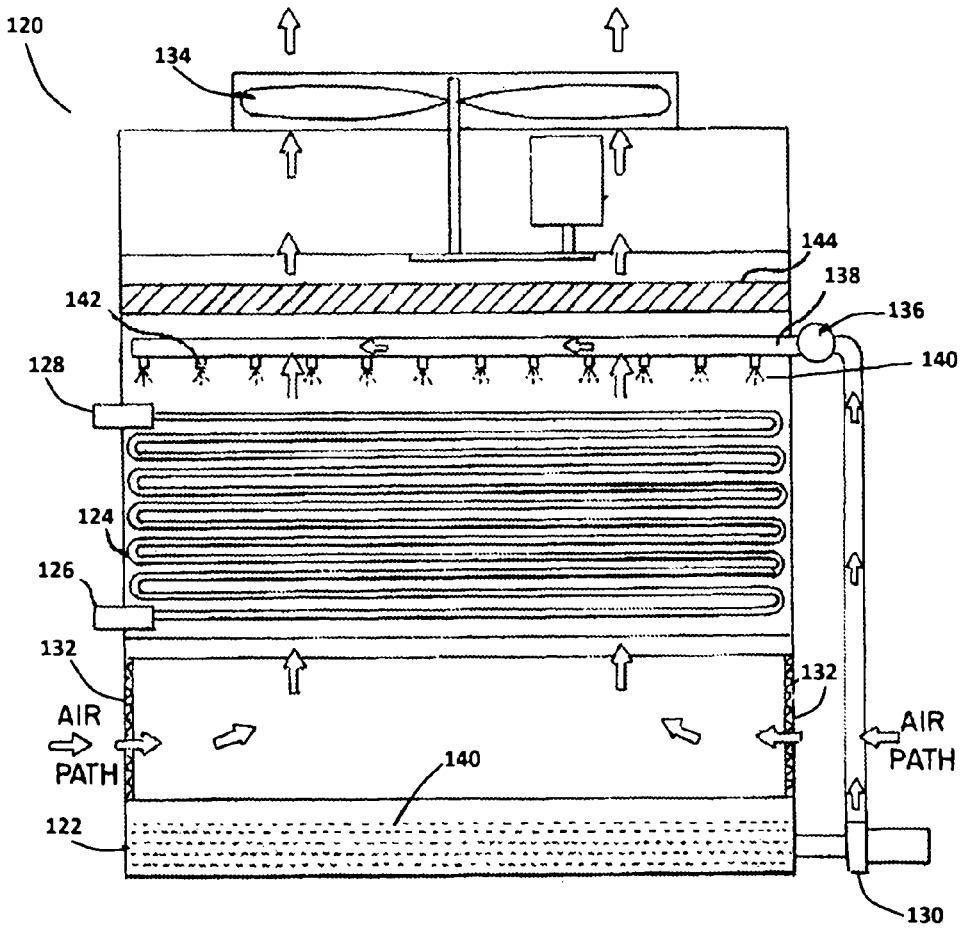
FIG. 1 is a side view of a cooling tower with an indirect heat exchanger in accordance with an embodiment of the present invention.

Referring now to FIG. 1, a closed circuit cooling tower (hereafter 'cooling tower') is shown at 120. Such cooling tower includes an indirect heat exchange section which is comprised of a plurality of coils 124. Such coils 124 are operatively connected to an inlet header 128 to receive a fluid to be cooled and to an outlet header 126 to redistribute the cooled fluid. The fluid to be cooled could be water or a glycol product or other heat transferring fluid or a refrigerant to be condensed. Fan 134 is usually located near the top of cooling tower 120; fan 134 draws air inwardly through air inlet 132 to provide cross and counter flow air across coils 124. Closed circuit cooling tower 120 also includes sump 122 located at the bottom of cooling tower 120. An evaporative liquid 140, usually water, is distributed downwardly from evaporative liquid distribution line 138 from nozzles 142 over indirect heat exchanger coils 124. Such evaporative liquid 140 is collected in sump 122 after passing over indirect heat exchanger coils 124. Pump 130 is operatively connected to outlet 142 from sump 122, and pump 130 pumps evaporative liquid 140 to evaporative liquid header 136. Evaporative liquid 140 is distributed to a plurality of evaporative liquid distribution lines 138 from evaporative liquid header 136.

Depending upon the heat exchange capacity required from apparatus 120, the number of water distribution lines 138 can vary from 1 to 6 legs per indirect evaporative coil section 124, with the length of each leg varying between 3-36 feet. Depending on spray water flow rate, the number of discharge openings or nozzles 142 per heat exchanger coil 124 indirect section will vary between 9-180 nozzles. Likewise, pump 130 is sized to provide the optimum spray flow rate described for a continuous supply of cooling water pumped to spray nozzles 142 to produce a supply of water across the entire span of the coil assembly 124. The optimum supply rate is 2.5 to 3.5 gallons per minute of water per square foot of the top surface area of coil assembly 124. Upper drift eliminator 144 is interposed between the top of the liquid distribution lines 138 and fan 134 to remove the water droplets entrapped by the primary air stream while evaporatively cooling the water descending through indirect heat exchange coils 124.

For many years, it was thought that optimum indirect heat exchanger operation was achieved by a heavier flow of evaporative liquid over indirect heat exchanger coils. Such flows were frequently in the range of 4.5 to 6 or even higher gallons per minute per square foot of indirect heat exchanger coil top surface area. Such flows are undesirable due to the electricity required to operate pumps to deliver that high of flow rates of evaporative liquid from the cooling tower sump. Further, air pressure drop through the heat exchanger coils is increased with the presence of that high amount of evaporative liquid passing through the outside of heat exchanger coils. Such air pressure drop impedes fan performance and overall efficiency of the indirect heat exchanger. Noise from excessive fan, fan motor size, and more dense falling water droplets are also undesirable consequences of the high evaporative liquid flow rates.

The present inventive design and operation of such indirect heat exchangers results largely from a realization that an optimum performance is achieved with a lesser flow rate of evaporative liquid across the coils. Ideal flow rates are from 2 to 4 gallons per minute of evaporative liquid per square foot of indirect heat exchanger coil top surface area, and optimum flow rates are from 2.5 to 3.5 gallons per minute of evaporative liquid per square foot of indirect heat exchanger coil top surface area. Such flow rates are especially efficient from a heat exchange point of view when the coil density of closed circuit cooling tower indirect heat exchanger increases as will be described below. Another realization in the performance of indirect heat exchangers having dense coil sections is that a high flow rate of evaporative liquid across the coil section actually does not lead to improved performance. The reason for this is that the evaporative liquid being supplied at the high flow rates does not contact the outside of the coils for enough time to absorb heat in an efficient manner while excess thickness of the evaporative water film increases the thermal resistance. The ideal flow rates of the present inventive design and operation of an indirect heat exchanger of 2 to 4 gallons per minute of evaporative liquid per square foot of indirect heat exchanger coil top surface area optimizes the sensible and latent heat exchange ability of the evaporative liquid passing across the coils.

Another realization in the performance of indirect heat exchangers having coil sections is that the effect of the lower flow rate of evaporative liquid over the coils is related to the projected tube area relative to the coil width and the number of tubes deep of the coil structure, and to a lesser degree the projected fin area if the coil has fins, and to a lesser degree the operating fluid conditions, and to an even lesser degree the volume of air moved across the coil structure by the fan or fan motor power related to the desired operation of the indirect heat exchanger. While the operating conditions and amount of airflow impact the performance effect of lower spray flow rates, the primary three governing factors are described in such relationship can be expressed generally as the Density Zone Profile $$DZP=C_f*NROWS*[(NCKTS*D_p)/C_w]^2 \qquad \text{Equation 1}$$

Where: DZP=Density Zone Profile Number $C_f$=correction factor for fins described in table 1

NROWS=number of tubes fed from top to bottom (passes)

Figure 8:
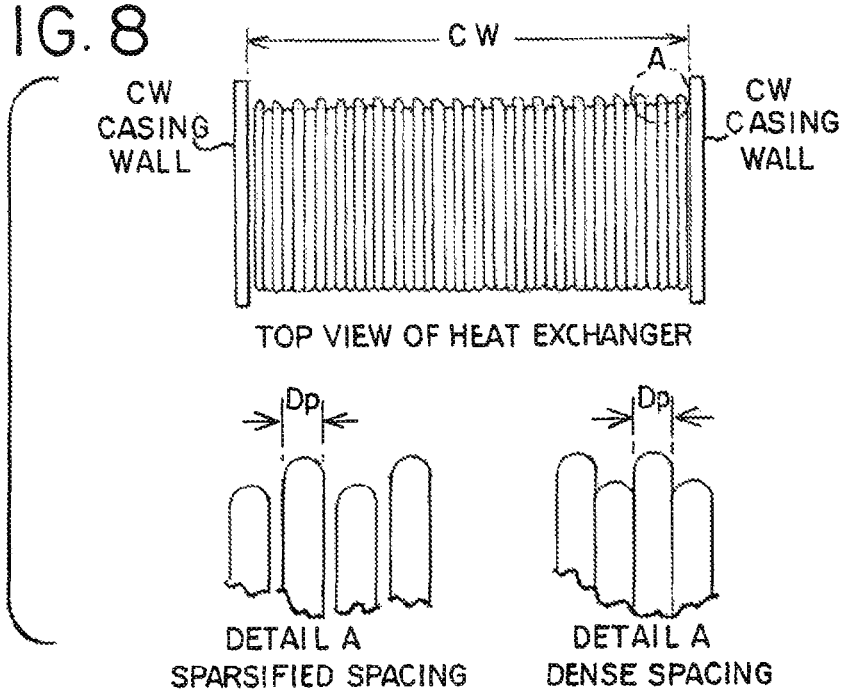
FIG. 8 is a detailed top view of an indirect heat exchanger coil structure in accordance with an embodiment of the present invention.

NCKTS=number of circuits in a casing width (See FIG. 8)

Figure 5:
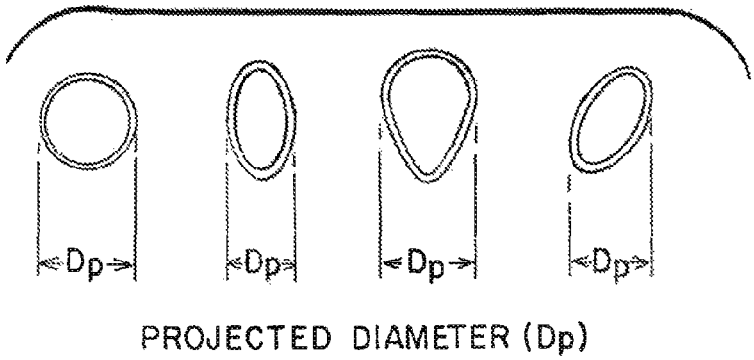
FIG. 5 is a detailed view of examples of tube shapes used in the indirect heat exchanger in accordance with an embodiment of the present invention.

$D_p$=projected tube diameter, inches (See FIG. 5)

$C_w$=casing width, inches (See FIG. 5)

Following this equation, when the DZP number is greater than 14, then the sensitivity to capacity improvements with reduced spray flow rates become significant, 5-10% depending on operating parameters and air flow rates. When the DZP number is between 10 to 14, the sensitivity to capacity improvement with reduced spray flow rates become minor, between 2-4% depending on operating parameters and air flow rates. When the DZP number is very close to 10, then the sensitivity to capacity improvement with reduced spray flow rates become negligible, typically ±only 1% depending on operating parameters and air flow rates. Finally, when the DZP number is less than 10, the sensitivity to capacity improvement with reduced spray flow rates become reversed, meaning it is better to maintain higher spray flow rates.

It should be noted however, that with DZP<10, higher spray flow rates only gain a few percent in capacity and the benefits of higher spray flow rates and hence higher spray flow pump power consumption should be examined on a case by case basis. In most cases, having too much spray pump horsepower even when DZP<10 only benefits the customer application during extreme loadings which is not a significant part of the year. For the $C_f$, fin correction factor, there are a lot of variables when describing fins on heat transfer tubes such as fin density, fin thickness, fin width, fin height and fin efficiency. To simplify the fin correction factor, the inventors reviewed these variables and came up with a rather simple governing relationship, as shown in Table 1.

TABLE 1

Describes Fin correction factor ($C_f$)

| % of Rows that are finned | Description | $C_f$ (finned correction factor |
|---|---|---|
| 0% | None of the tubes are finned | 1.0 |
| 5% < finned rows < 33% | | 1.3 |
| 33% ≤ finned rows ≤ 66% | | 1.6 |

TABLE 1-continued

| Describes Fin correction factor ($C_f$) | | |
|---|---|---|
| % of Rows that are finned | Description | $C_f$ (finned correction factor |
| >66% finned rows | Most or all rows are finned | 2.0 |

In table 2, the DZP numbers for a number of examples are demonstrated:

For 6 row sparsified or dense double serpentine (SERP) coils, NROWS=2*6=12;

for 12 row sparsified and dense double serpentine (SERP) coils, NROWS=2*12=24.

TABLE 2

| DZP Examples | | | | | | |
|---|---|---|---|---|---|---|
| Coil description | $C_f$ Fin corr factor | $C_w$ Casing Width | NCKTS Number of circuits | NROWS Number of rows | $D_p$ Projected diameter | DZP Density Zone Profile number |
| 6 row sparse double serp no fins | 1.0 | 114.75" | 86 | 12 | 1.05" | 7.4 |
| 6 row sparse double serp 100% finned | 2.0 | 114.75" | 86 | 12 | 1.05" | 14.9 |
| 6 rows dense double serp no fins | 1.0 | 114.75" | 104 | 12 | 1.05" | 10.9 |
| 12 row sparse double serp no fins | 1.0 | 114.75" | 86 | 24 | 1.05" | 14.9 |
| 12 row dense double serp no fins | 1.0 | 114.75" | 104 | 24 | 1.05" | 21.7 |
| 12 row sparse double serp with 50% fins | 1.6 | 114.75" | 86 | 24 | 1.05" | 23.8 |

It should be noted that most coils that are sold in closed circuit cooling towers and evaporative condensers today have DZP>10 and a good majority of the coils have DZP numbers>14 making the transition from higher spray flow rates to lower spray flow rates suggested by this invention worthwhile for the majority of customers' applications.

TABLE 3

| Sensitivity of coil geometry via Density Zone Profile number | | |
|---|---|---|
| DZP Number | | Capacity at 3 GPM/ft^2 relative to 6 GPM/ft^2 |
| DZP < 10 | Spray flow rates > 3 GPM/ft^2 may be used on a case by case basis | 0% to −3% |
| DZP ≈ 10 | Spray flow rate effect is negligible | −1% to +1% |
| 10 < DZP_ < 14 | Lower Spray flow rates impact is minor but absolutely positive | +2% to +4% |
| DZP > 14 | Lower Spray flow rate impact is major | +5 to +10%+ |

Figure 2:
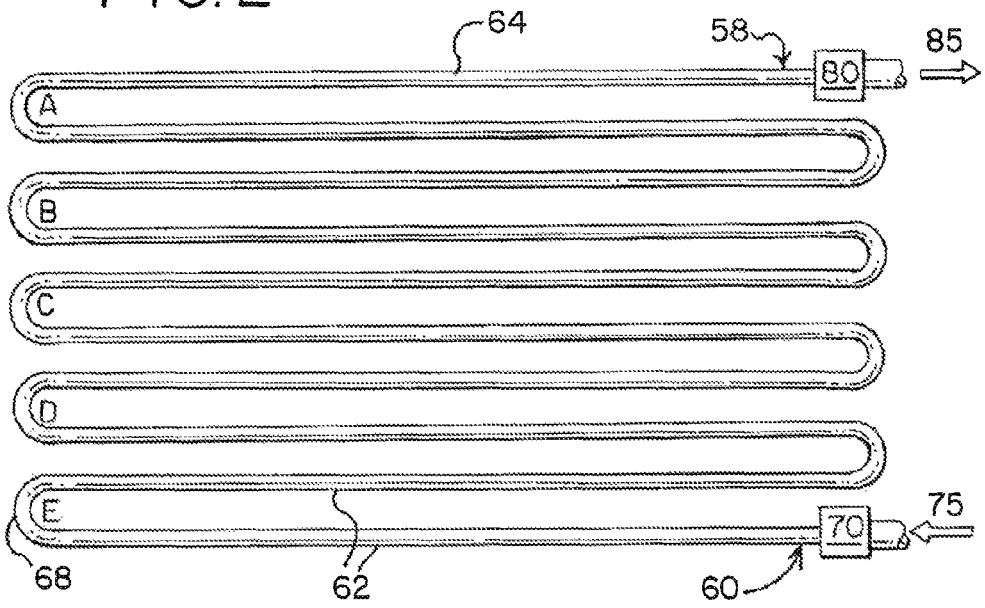
FIG. 2 is a side view of a single coil circuit of an indirect heat exchanger in accordance with an embodiment of the present invention.
Figure 3:
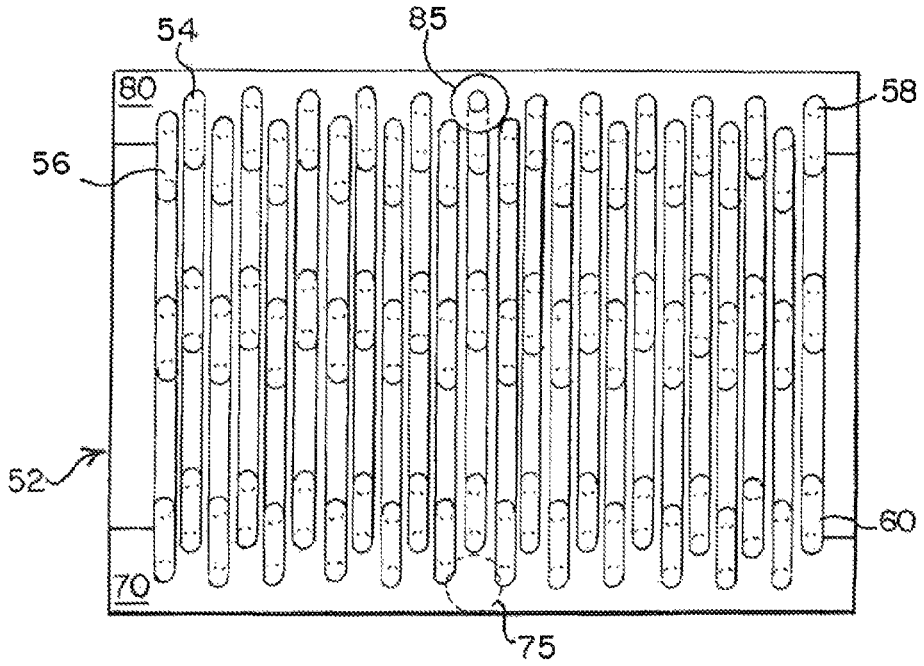
FIG. 3 is a detailed end view of an indirect heat exchanger coil structure in accordance with an embodiment of the present invention.
Figure 4:
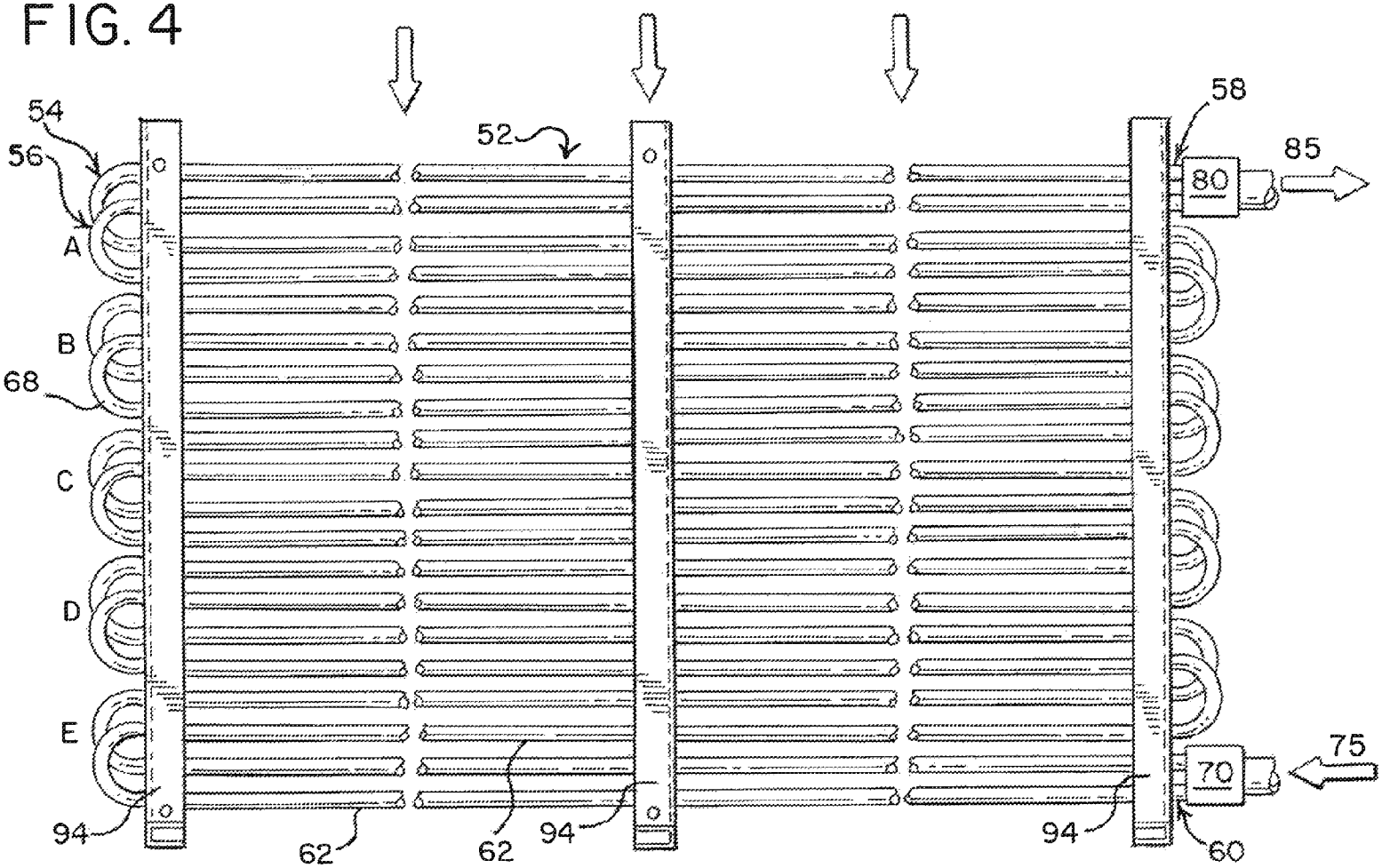
FIG. 4 is a detailed side view of an indirect heat exchanger coil structure in accordance with an embodiment of the present invention.

Referring now to FIGS. 2, 3, and 4, coil assembly 52 of the indirect evaporative cooling section 124 (FIG. 1) will now be explained in greater detail. More particularly seen in the side view of FIG. 3, coil assembly 52 is preferably a generally rectangular shaped structure comprising a series of horizontally and closely spaced parallel circuits 54 and 56 of serpentine shape. All circuits 54, 56 have a circuit top end 58 and a circuit bottom end 60 connected to a top fluid header 80 and to a bottom fluid header 70, respectively. It should be understood that the supply or discharge functions of each of the headers could change, depending upon the actual use of apparatus 120, i.e., if it is being used as an evaporative condenser. In that case, the hot gas would enter indirect coil assembly 52 at the top side, where top header 80 would now serve as the supply header. FIG. 2 shows that each of the headers 70 and 80 could be generally rectangular shaped with both headers located on the same sides or ends of the single coil assembly 52. It is also seen that top inlet header 80 consists of a single supply branch 85, connected generally to the center of inlet header 80 and on the opposite header side wall to which the individual inlet circuit ends 58 are connected. The single inlet supply branch 85 supplies the fluid to be cooled in a generally parallel or concurrent direction to the direction of the fluid flowing inside the series of circuits. Bottom outlet header 70 also has a single branch 75 generally attached at the center of header 70, and it is seen that this branch is horizontally spaced directly below inlet supply branch 85 so that the cooled fluid exiting coil assembly 60, exits in a direction generally parallel, yet opposite to the fluid flowing within inlet supply branch 85. Depending on the fluid flow rates, there may be multiple branches 85 and 75.

Referring now to FIG. 4, it is seen that each individual circuit 54, 56 within coil assembly 52 consists of a single, continuous length of coil tubing that is subjected to a bending operation which forms the tubing into several U-shaped rows A-E, that are in a vertical and equally-spaced relationship from each other, thereby providing each circuit 54, 56 with a resultant serpentine shape. Each row is of substantially the same dimensional length, but is not required, with each individual row generally comprising two generally straight (or possibly sloping) tubing run sections 62 connected together by a generally U-shaped return section 68. By forming each row and each of the circuits 54, 56 in exactly the same way, the heat load between alternating circuits 54, 56 will effectively remain constant, as long as all other factors between the circuits such as temperature and flow rates are equal. Indirect heat exchange assembly 52 is shown in this embodiment as constructed with circuits 54 and 56, having ten total rows each, 2*(A-E), but the exact number of rows will depend upon the amount of heat transfer surface area required for each particular application. For describing a consistent number of rows in the DZP equation, when feeding two circuits with ten rows, we describe this as a 20 row coil. Similarly, if we feed four sets of circuits with 10 passes, that would be described as 40 rows in the DZP equation. The determination of how many rows are required in an application made by engineering heat transfer principals. Tubing runs 62, and for that matter, each of the individual rows A-E, substantially spans between side walls 20 and 22 and depending upon the overall size of the indirect evaporative cooling section 50, might require at least two structural supports 94 on each end of the rows to keep the tubes from sagging. The supports will also ensure proper tube spacing between the adjacent individual circuits 54, 56.

Still referring to FIG. 4, it is also clear to see how each individual circuit 54, 56 is attached to the inlet and outlet headers 80 and 70, respectively, by inserting and attaching circuit inlet end 58 and outlet end 60, into the sidewall of respective inlet and outlet headers 80 and 70, and then preferably welding the tubing/header interface together, although other methods of attachment, such as rolling the tubes into the header, could be used. Note the heavy arrows in FIG. 4; they represent the preferred direction of entering air and evaporative cooling water. All adjacent circuits 56 within the series of circuits comprising assembly 52 are slightly staggered lower than the starting circuits 54, and as FIG. 4 only represents two circuits side-by-side in close tolerance, FIG. 3 best shows the spacing within the series arrangement. Depending upon the heat exchange capacity of apparatus 10, the number of individual circuits 54, 56 can range from 23 to 56 circuits per single coil assembly 52, and cooling apparatus 10 could actually contain multiple single coil assemblies 52 stacked on top of each other if greater capacity is needed. No matter how many circuits are utilized, it is seen from FIG. 3 that the spacing between circuits is of very tight tolerance such that the entire series of individual circuits 54, 56 effectively performs or functions as a continuous, or uninterrupted thermal face of heat exchange area per individual row when it is interacting with the entering primary air stream and evaporative cooling water.

Referring now to FIG. 5, regardless of tube shape, the projected diameter, $D_p$ in equation DZP, is simply defined maximum horizontal width of the tube shape perpendicular to the upflowing air direction.

Figure 6:
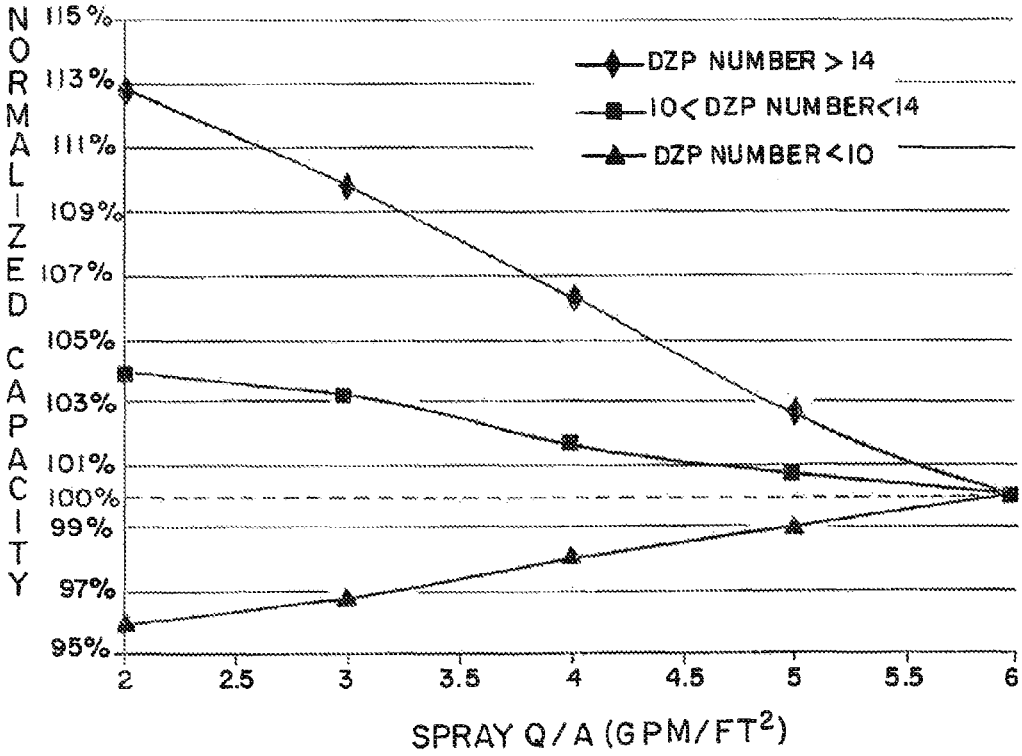
FIG. 6 is a graph of heat exchange performance versus evaporative liquid flow rate for an indirect heat exchanger in accordance with an embodiment of the present invention.

Referring now to FIG. 6, a graph of the flow rate of evaporative liquid in gallons per minute per square foot of area of the top surface of the indirect heat exchanger coil section versus the performance capacity of the indirect heat exchanger is shown. This figure supplements Table 3. As shown, when the DZP>14, decreasing the flow rate from 6 gallons per minute per square foot to 3 gallons per minute per square foot increases performance of the indirect heat exchanger by about 10 percent. Combining such improved heat exchanger performance with the inherent savings in electricity from lower electricity costs due to lesser pump size and operation, demonstrates the advantages of the present invention.

Figure 7:
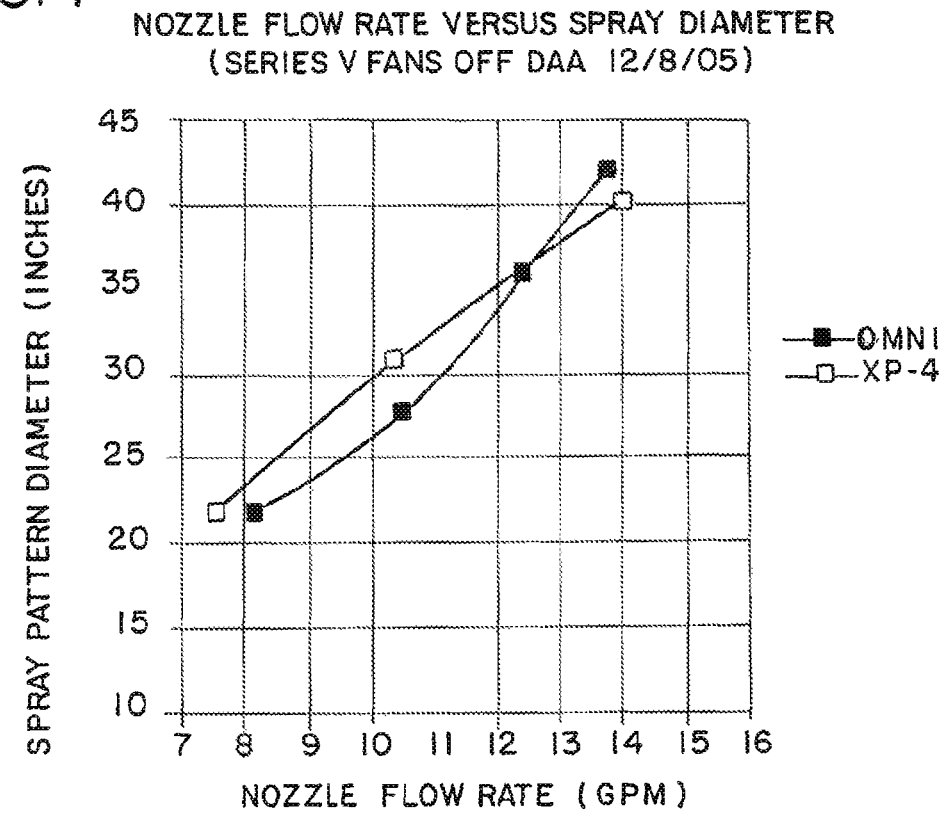
FIG. 7 is a graph of evaporative liquid flow rate versus spray pattern diameter for an indirect heat exchanger in accordance with an embodiment of the present invention.

Referring now to FIG. 7, a graph of evaporative liquid flow rate versus spray pattern diameter from each nozzle or opening in the evaporative distribution line is shown. Knowing the target spray coverage at 2.5 to 3.5 gallons (3 gallons being optimal) per minute per square foot of indirect heat exchanger coil top surface area allows the calculation of evaporative liquid distribution line spacing and nozzle or discharge opening spacing in each line.

Referring now to FIG. 8, the sparsified and dense circuit arrangements in relation to casing width, projected diameter and how they affect the DZP number are shown.

In the case where an indirect heat exchanger was previously installed which incorporates higher spray flow rates>3.5 GPM/Ft^2, a retrofit can be performed on that heat exchange apparatus to take advantage of the capacity gain at lower spray flow rates and if desired at lower spray pump power consumption. The ways to accomplish this are:

Calculate the DZP. If >10, then the apparatus is a candidate

Remove existing spray system

Install spray system designed for spray flows at 2.5-3.5 GPM/ft^2

Reduce the spray pump flow rate to 2.5-3.5 GPM/FT^2 by:

1) Changing pump impellor

2) Changing pump

3) Installing a variable speed drive (but set at constant speed)

4) Install a flow control valve on existing pump discharge pipe

5) Install a flow restrictor in existing pump discharge

6) Install a flow restrictor in existing pump discharge piping

Or a combination of these steps.

Once the retrofit is complete, the spray flow rate must be measured to insure 2.5 GPM/FT^2<flow rate<3.5 GPM/FT^2 in order to achieve the capacity gain. Once the flow rate is set, the spray pattern must be checked to insure proper coverage, especially when the fan(s) is off.

What is claimed is:

1. A method of operating an indirect heat exchanger comprising:

providing an indirect heat exchanger comprising:

a plurality of coils having length sections and bend sections, a fan to draw air across the plurality of coils, a water distribution system located above the plurality of coils and comprising a series of discharge sections, an inlet header connected to the series of discharge sections, a plurality of openings in each discharge section that allow water to be distributed downwardly over the plurality of coils and a sump to collect the water after passing over the plurality of coils, wherein the water distribution system also comprises an exit opening in the sump, and a pump connected to the exit opening, and a return line to supply the water from the sump to the inlet header of the water distribution system, with the pump having a capacity at any given time results in water being discharged from the water distribution system onto the plurality of coils to provide a density zone profile (DZP) according to:

$$DZP=C_f*NROWS*[(NCKTS*D_P)/C_W]^2 \quad \text{Equation 1}$$

Where:

DZP=Density Zone Profile Number $C_f$=correction factor for fins described in table 1 below NROWS=number of tubes fed from top to bottom NCKTS=number of circuits in a casing width $D_P$=projected tube diameter, inches $C_W$=casing width, inches Wherein DZP is the density zone profile of the plurality of coils,

TABLE 1

| % of Rows that are finned | Description | $C_f$ (Finned Correction factor) |
|---|---|---|
| 0% | None of the tubes are finned | 1.0 |
| 5% < finned rows < 33% | | 1.3 |
| 33% < finned rows < 66% | | 1.6 |
| >66% finned rows | Most or all rows are finned | 2.0 |

wherein a water distribution spray water flow rate is set to:

greater than 4 gpm/ft$^2$ when DZP is less than 10, and between 2 to 4 gpm/ft$^2$ when DZP is greater than or equal to 10.

2. The method of claim 1 further comprising a controller to vary the pump speed and pumping capacity and thusly vary the water discharge rate.

* * * * *